US006076052A

United States Patent [19]

Bannai et al.

[11] Patent Number: 6,076,052

[45] Date of Patent: Jun. 13, 2000

[54] MESSAGE PLAYBACK DEVICE AND MESSAGE PLAYBACK METHOD

[75] Inventors: Yuichi Bannai; Yoshihisa Takebe; Akira Fukushima, all of Chiba, Japan

[73] Assignee: Uniden Corporation, Tokyo, Japan

[21] Appl. No.: 08/826,034

[22] Filed: Mar. 28, 1997

[30] Foreign Application Priority Data

Oct. 31, 1996 [JP] Japan ..... 8-290679

[51] Int. Cl.[7] ..... G10L 21/00; G10L 21/04

[52] U.S. Cl. ..... 704/201; 704/211

[58] Field of Search ..... 704/201, 270, 704/272, 278, 211; 341/110; 360/69; 365/185.03

[56] References Cited

U.S. PATENT DOCUMENTS

| | | | |
|---|---|---|---|
| 4,698,776 | 10/1987 | Shibata | 704/201 |
| 4,772,873 | 9/1988 | Duncan | 341/110 |
| 4,989,179 | 1/1991 | Simko | 365/185.03 |
| 5,164,915 | 11/1992 | Blyth | 360/69 |
| 5,511,000 | 4/1996 | Kaloi | 704/201 |
| 5,687,279 | 11/1997 | Matthews | 704/201 |

FOREIGN PATENT DOCUMENTS

| | | |
|---|---|---|
| 58-59657 | 4/1983 | Japan . |
| 61-158254 | 7/1986 | Japan . |
| 1-120939 | 5/1989 | Japan . |
| 4-133551 | 5/1992 | Japan . |
| 4-343553 | 11/1992 | Japan . |
| 5-327857 | 12/1993 | Japan . |
| 5-334893 | 12/1993 | Japan . |
| 7-123147 | 5/1995 | Japan . |

OTHER PUBLICATIONS

Computer Dictionary, 2nd Edition, Microsoft Press, p. 168, 1994.

*Primary Examiner*—David D. Knepper
*Attorney, Agent, or Firm*—McDermott, Will & Emery

[57] ABSTRACT

In an flash memory which is an IC memory, a playback time proportional to a period of time when a rewind key is continuously pressed down, or a playback time proportional to a period of time when the rewind key is continuously pressed down while time-stamp information is played back, and a message is read out and played back from a message address at a destination for playback corresponding to the playback time. With this feature, a message address at a destination for playback can be changed according to a period of playback time corresponding to a period of time when the rewind key is continuously pressed down.

17 Claims, 13 Drawing Sheets

MESSAGE PLAYBACK DEVICE AND MESSAGE PLAYBACK METHOD

FIELD OF INVENTION

The present invention relates to a message playback device for playing back any message recorded in an IC (Integrated Circuit) memory as well as a message playback method.

BACKGROUND OF THE INVENTION

Conventionally, in electronic equipment having a function of recording/playback any message which is audio data, the message is recorded in a magnetic tape. There is a telephone set with a function of recording messages, from callers even during absence of an owner thereof as a representative device of this type of electronic equipment.

This telephone set with the function for recording messages from callers even during absence of an owner thereof generally records messages as well as time-stamp information indicating the time each of the messages is recorded, as a pair on the magnetic tape in order of reception. The magnetic tape then must be rewound to a desired position in order to listen to the recorded message by playing it back.

Although a driving mechanism for fast-rewinding or fast-forwarding the magnetic tape to any given position is generally incorporated as standard in the telephone for recording messages from callers during absence of an owner thereof, a certain period of time is spent according to the number of revolutions required for fast-rewinding or fast-forwarding when the driving mechanism is operated. For this reason, it is impossible to get any recorded message at a desired position instantly.

However, in recent years, it has become possible to listen to any recorded message at a desired position instantly as a result of development of the digital recording/playback technology in which recording or playback messages is executed by using an IC memory as a data storage medium.

As an analogous technology in which this type of digital recording/playback technology is applied, there are the technologies disclosed, for instance, in Japanese Patent Laid-Open Publication No. HEI 1-120939 and Japanese Patent Laid-Open Publication No. HEI 5-334893. Disclosed in Japanese Patent Laid-Open Publication No. HEI 1-120939 is technology for reading digital audio information from an IC memory according to addresses each stored at a point of time when digital audio information is recorded. In the other technology, a user is informed about a break of audio data with a detection tone when a mark indicating the break is detected during fast-rewinding or fast-forwarding, as disclosed in Japanese Patent Laid-Open Publication No. HEI 5-334893.

As described above, in the digital recording/playback technology as indicated by the example of the conventional technology, the speed required for accessing and reading any message for playback is improved as compared to that in a case of magnetic tapes because the message (digital audio information or audio data or the like) is recorded in an IC memory. However, the position of each message is recorded and managed with an address or the mark when the message is recorded so that the address or mark will be a starting point when the message is played back. For this reason, playback of each message is started from a header section of the message. Hence, it is impossible to play back any message from an arbitrary position as in magnetic tapes.

SUMMARY OF THE INVENTION

It is an object of the present invention to provide a message playback device which can play back a message from any arbitrary position in the message, as in a magnetic tape, and a message playback method.

With the message playback device according to the present invention, in an IC memory, a message is read out from a message address at a destination for playback depending on an inputted playback time and played back. The destination for playback hence is not limited to a header section of the message, and the message address at the destination for playback can be changed according to a period of the playback time. As a result, it is possible to play back the message from an arbitrary position of the message, as in the case of a message recorded on a magnetic tape.

With the message playback device according to the present invention, in an IC memory, playback time is computed depending on a period of time a rewind key is continuously pressed down. A message is read out from a message address at a destination for playback according to the playback time and played back. The destination for playback thus is not limited to a header section of the message, and the message address at the destination for playback can be changed according to a period of the playback time corresponding to a period of time the rewind key is continuously pressed down. It thus is possible to play back the message from an arbitrary position of the message, as in a message recorded on a magnetic tape.

With the message playback device according to the present invention, in an IC memory, a message is read out from a message address at a destination for playback depending on a playback time inputted while time-stamp information is played back. The destination for playback thus is not limited to a header section of the message corresponding to the time-stamp information, and the message address at the destination for playback can be changed according to a period of the playback time. Hence, even while the time-stamp information is played back, it is possible to play back the message from an arbitrary position corresponding to the time-stamp information, as in a message recorded on a magnetic tape.

With the message playback device according to the present invention, in an IC memory, playback time is computed depending on the period of time a rewind key is continuously pressed down while time-stamp information is generated. A message is read out from a message address at a destination for playback depending on the playback time and played back. The destination for playback thus is not limited to a header section of the message corresponding to the time-stamp information, and the message address at the destination for playback can be changed according to a period of the playback time corresponding to a period of time the rewind key is continuously pressed down. Hence, even when the time-stamp information is being played back, it is possible to play back the message from an arbitrary position corresponding to the time-stamp information, as in the case of a message recorded on a magnetic tape.

In a message playback device according to the present invention, a computing means controls a playback time according to the period of time required for playing back a current message so that a destination for playback is limited within a message address of the current message. Hence, it is possible to partially play back within one message until the playback time reaches the period of time required for playing back.

In a message playback device according to the present invention, a computing means computes playback time by multiplying the period of time a rewind key is continuously pressed down by m (m: a natural number), whereby rewind speed becomes faster. In this case, it is possible to realize a rewind operation close to that of a magnetic tape, in an IC memory.

With the message playback method according to the present invention, playback time is obtained in an IC memory from a period of time the rewind key is continuously pressed down, and a message is read out and played back from a message address at a destination for playback corresponding to the playback time. Hence, the destination for playback is not limited to a header section of the message, and the message address at the destination for playback can be changed corresponding to a period of the playback time corresponding to a period of time the rewind key is continuously pressed down. In this manner, it is possible to play back the message from an arbitrary position of the message, as in a message recorded on a magnetic tape.

With the message playback method according to the present invention, playback time is obtained according to the period of time the rewind key is pressed while time-stamp information is being played back, and a message is read out and played back from a message address at a destination for playback corresponding to the playback time. Hence, the destination for playback is not limited to a header section of the message corresponding to the time-stamp information, and the message address at the destination for playback can be changed according to a period of the playback time corresponding to a period of time the rewind key is continuously pressed down. Thus, even when time-stamp information is being played back, it is possible to play back the message from an arbitrary position corresponding to the time-stamp information, as in the case of a message recorded on a magnetic tape.

Other objects and features of this invention will become understood from the following description with reference to the accompanying drawings.

DESCRIPTION OF THE PREFERRED EMBODIMENTS

Figure 1:
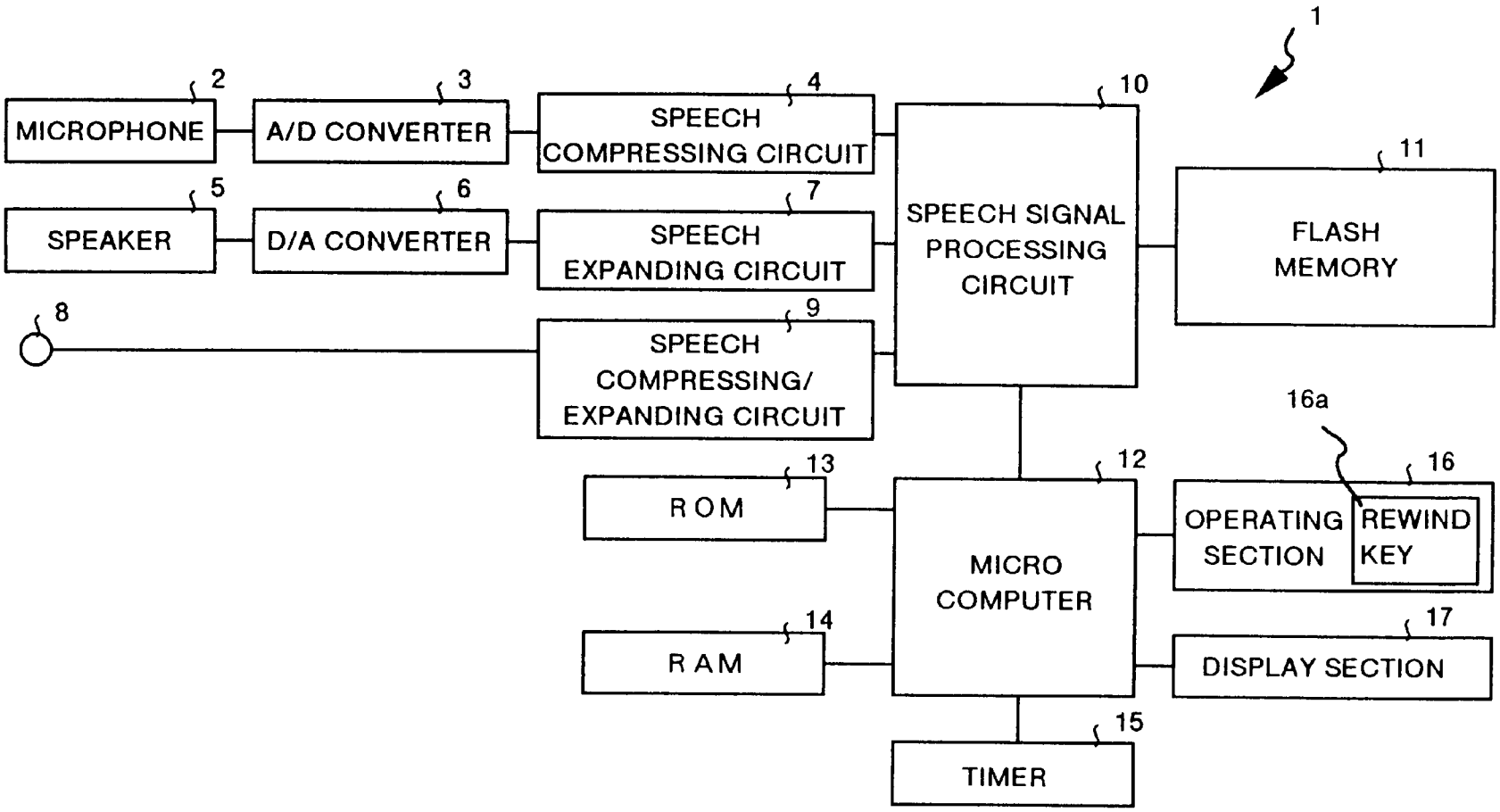
FIG. 1 is a block diagram showing a message playback device according to an embodiment of the present invention.

Detailed description is made hereinafter for preferred embodiments of the present invention with reference to the related drawings. FIG. 1 is a block diagram showing a message playback device according to one of the embodiments of the present invention, and in the figure, the reference numeral 1 indicates a telephone device with a function of unattended recording of messages (described as a telephone device hereinafter) as a representative example of message playback devices.

This telephone device 1 comprises, for instance, a microphone 2, an A/D converter 3, a voice compressing circuit 4, a speaker 5, a D/A converter 6, a speech expanding circuit 7, a terminal 8 of a telephone line (e.g. a digital line such as ISDN or the like) which is not shown herein, a speech compressing/expanding circuit (described as a speech C/E circuit hereinafter) 9, an speech signal processing circuit 10, a flash memory 11, a microcomputer 12, a ROM 13, a RAM 14, a timer 15, an operating section 16, and a display section 17.

The microphone 2 is a speech input device for inputting speech in this caller side while a telephone call is on for obtaining an analog speech signal thereto. The A/D converter 3 digitizes the obtained analog speech signal by the microphone 2 for obtaining a digital speech signal thereto.

The speech compressing circuit 4 obtains a compressed signal by compressing a digital speech signal outputted from the A/D converter 3 according to, for instance, an ADPCM (Adaptive Differential Pulse Code Modulation) system, and supplies the signal to the speech signal processing circuit 10.

The speaker 5 is a speech output device for outputting speech at the other side while a telephone call is on or outputting a recorded message when the message is played back, and forms speech by fetching the analog speech signal from the D/A converter 6. The D/A converter fetches a digital speech signal from the speech expanding circuit 7 and converts the signal to an analog signal to get an analog speech signal.

The speech expanding circuit 7 obtains an digital speech signal by expanding the compressed signal supplied from the speech signal processing circuit 10 according to the ADPCM system which is a compression system for the speech compressing circuit 4.

The audio C/E circuit 9 obtains a compressed signal by compressing a digital speech signal coming thereinto from the telephone line while a telephone call is on according also in this case to the ADPCM system and supplies the compressed signal to the speech signal processing circuit 10.

The audio C/E circuit 9 also obtains a digital speech signal by expanding the compressed signal supplied from the speech signal processing circuit 10 according to the ADPCM system and sends out the digital speech signal to the telephone line, not shown herein, through the terminal 8.

The speech signal processing circuit 10 is a circuit dedicated to speech signal processing such as a DSP (Digital Signal Processor) or the like. This speech signal processing circuit 10 controls units such as speech compressing circuit 4, speech expanding circuit 7, speech C/E circuit 9, and flash memory 11 or the like through communications with the microcomputer 12.

The flash memory 11 is a rewritable storage medium. This flash memory 11 stores a compressed signal for each message, in a case where a response message to be generated when unattended recording is operated is registered or in a case where a message from a caller is recorded when unattended recording is operated, according to control by the speech signal processing circuit 10.

It should be noted that the message recording includes an operation of recording time-stamp information (described as stamp information hereinafter) in order to record the reception time in correspondence thereto.

The microcomputer 12 is a device for controlling operations of this telephone device 1 as a whole according to the control program stored in the ROM 13 and is electrically coupled to each of the units as shown in FIG. 1.

This microcomputer 12 controls operations for calling/unattended recording operation (of the speech signal processing circuit 10 or the like), operations in response to key entries (of the operating section 16), display operations (by the display section 17), time control (by the timer 15), access to the control program (stored in the ROM 13), and operations for reading or writing data when each program is operated (RAM 14) or the like.

Figure 9:
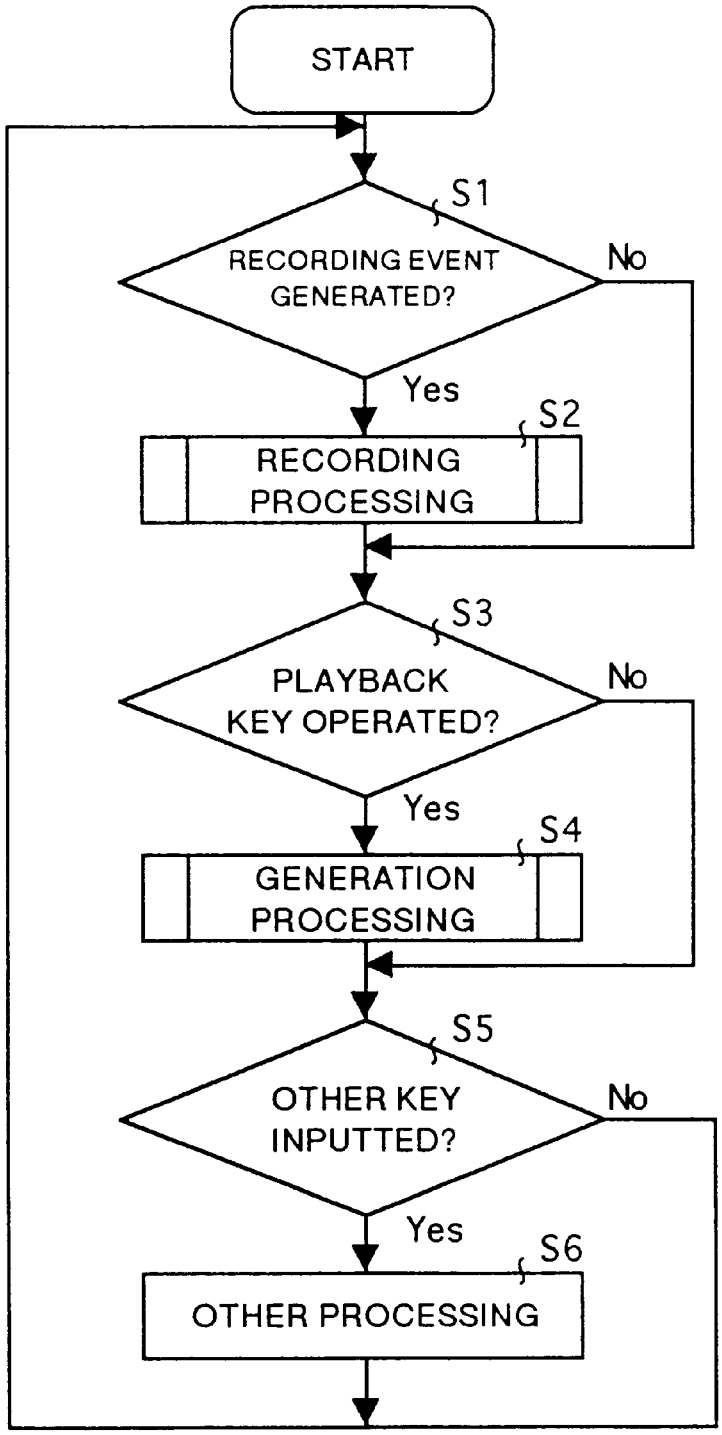
FIG. 9 is a flow chart illustrating main processing in this embodiment.
Figure 10:
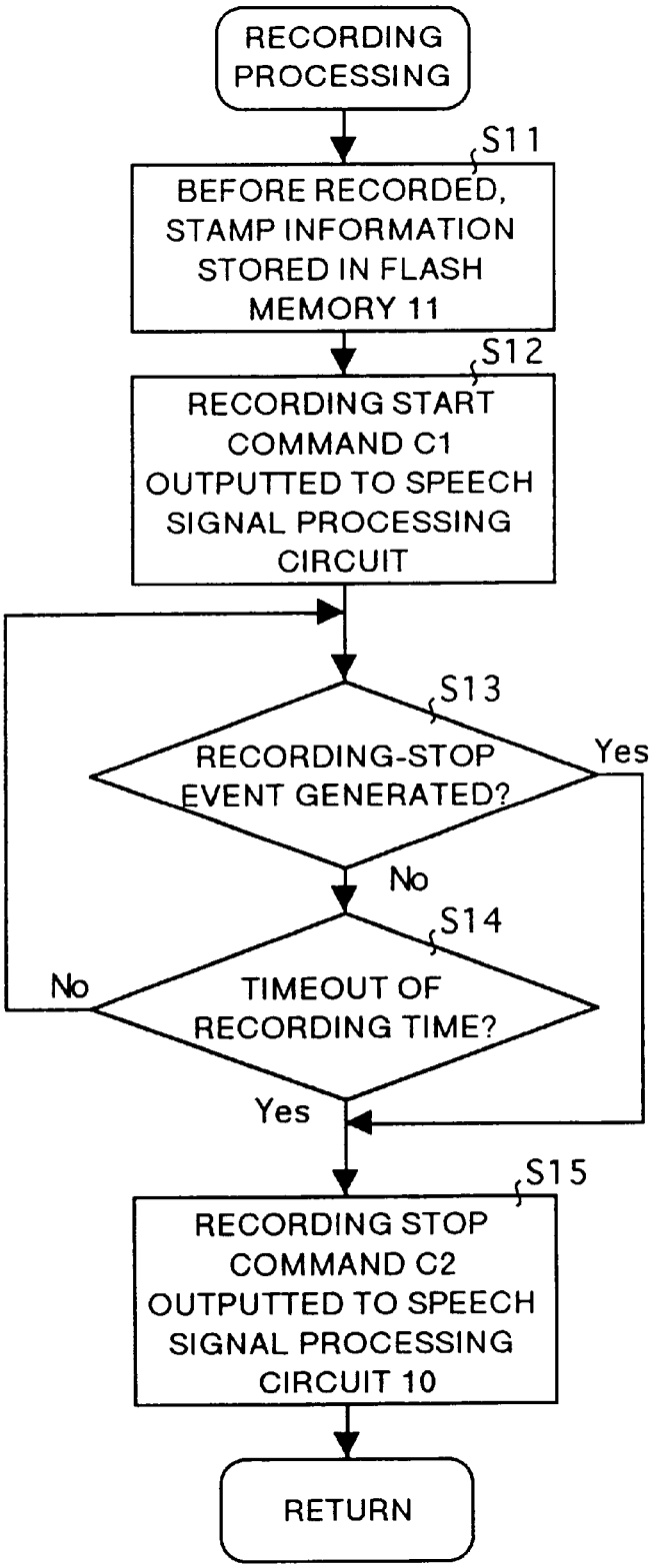
FIG. 10 is a flow chart explaining recording processing in this embodiment.
Figure 11:
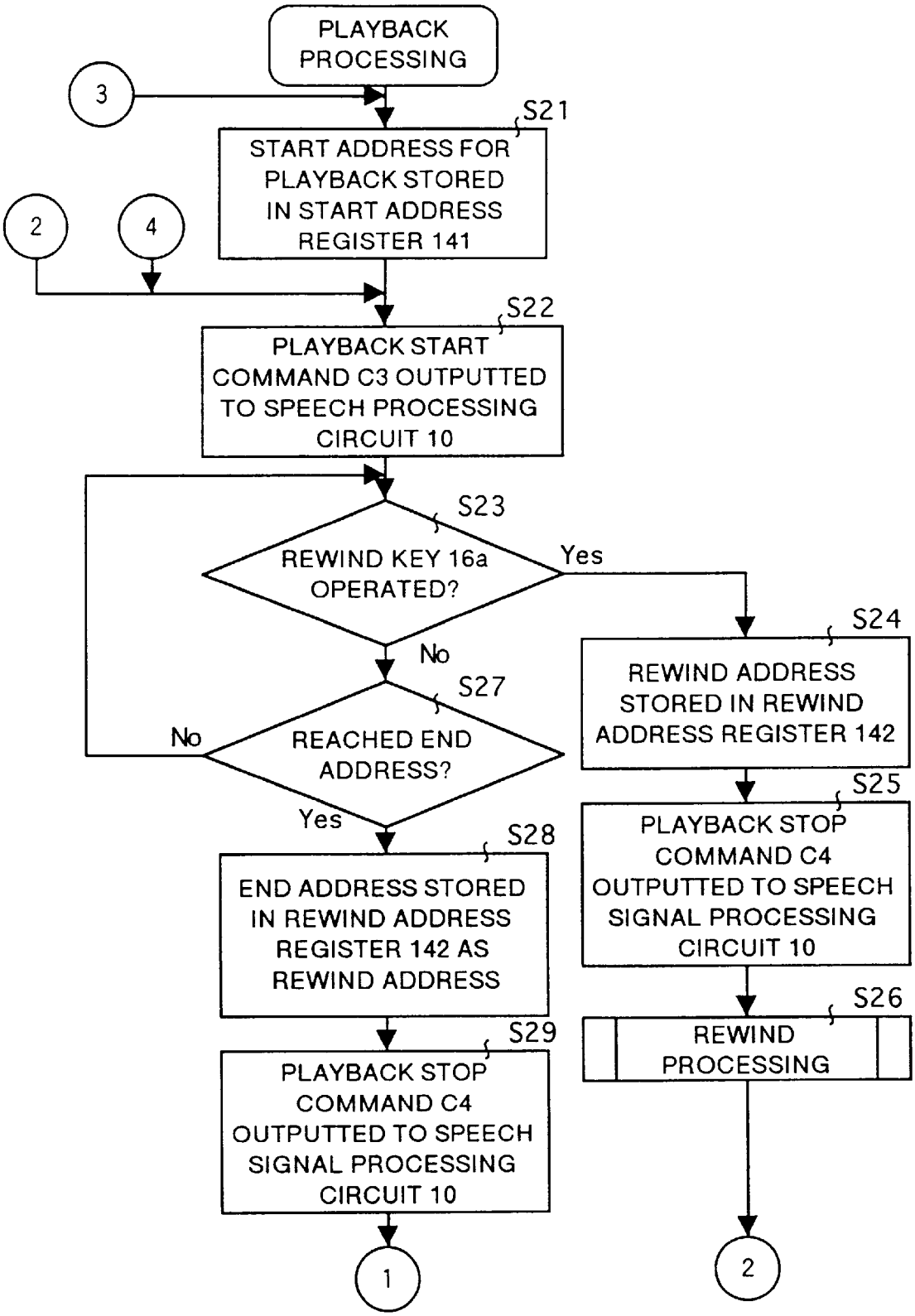
FIG. 11 is a flow chart explaining processing for playback in this embodiment.
Figure 12:
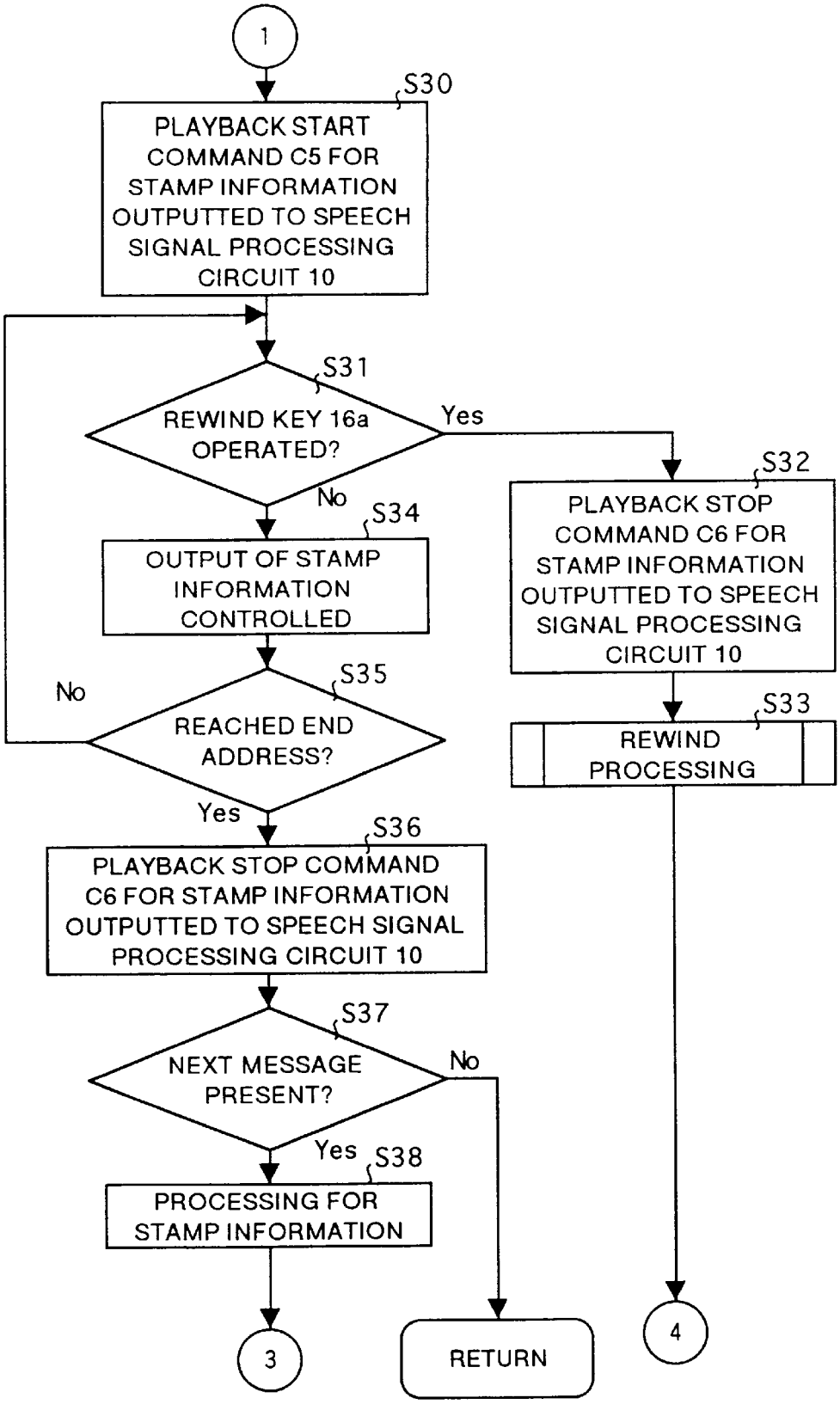
FIG. 12 is a flow chart explaining further processing for playback in this embodiment.
Figure 13:
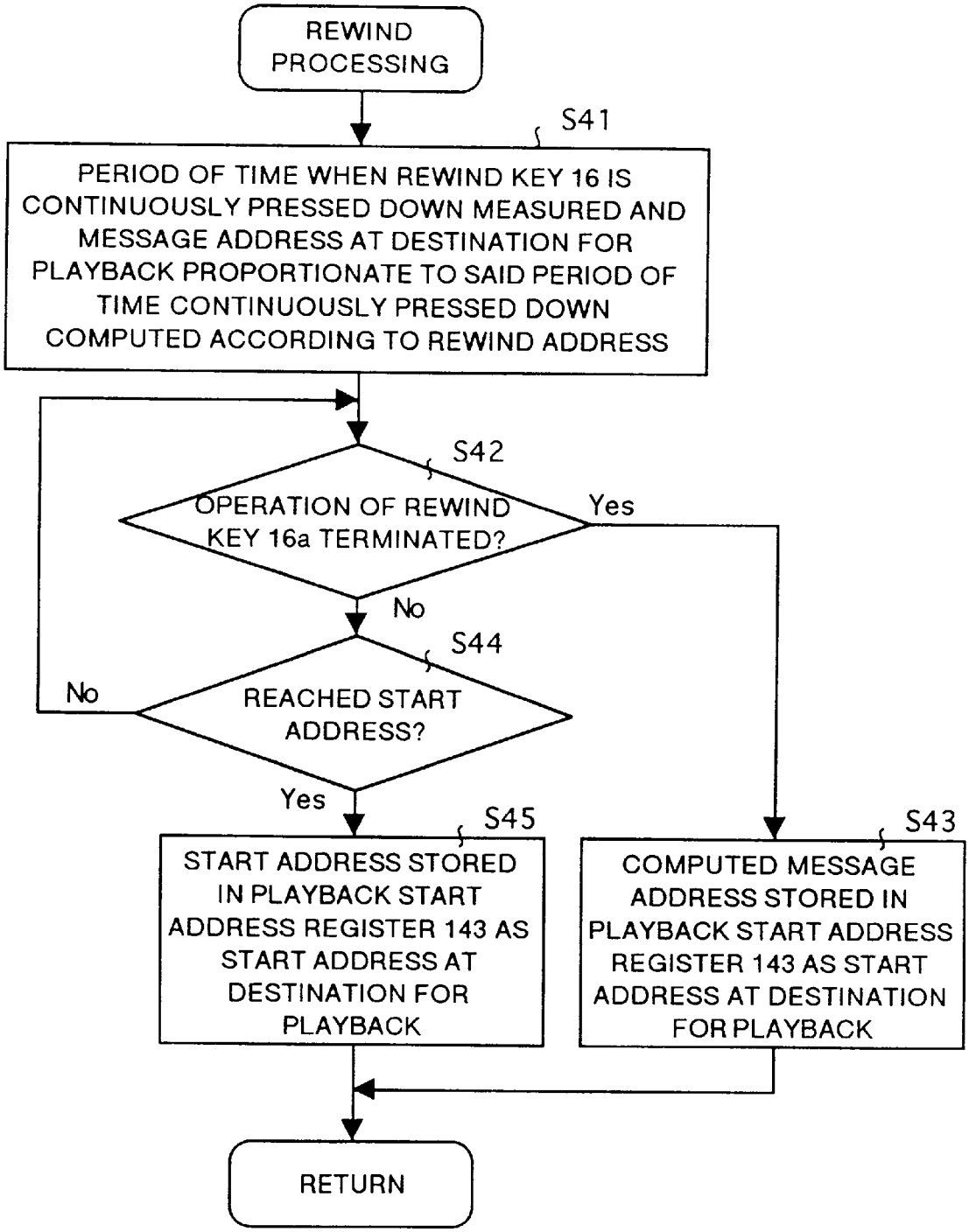
FIG. 13 is a flow chart explaining rewind processing in this embodiment.

The ROM 13 stores therein a control program for main processing according to the flow chart shown in FIG. 9, a control program for recording processing according to the flow chart shown in FIG. 10, a control program for playback processing according to the flow chart shown in FIG. 11 and FIG. 12, and a control program for rewind processing according to the flow chart shown in FIG. 13 or the like.

The RAM 14 is a memory used as a work area for various types of program when the microcomputer 12 is operated.

The timer 15 is a unit such as a real time clock for measuring time or the like and supplies time data to the microcomputer 12.

The operating section 16 has a plurality of keys such as a playback key for operating various types of functions for ordinary call or unattended recording and rewind key 16*a*, and supplies a key signal to the microcomputer 12 by sensing the fact that the key is pressed.

This rewind key 16*a* is a key for playing back the messages recorded in the flash memory 11 during unattended recording.

The display section 17 comprises an LCD or the like and displays data when the functions for ordinary telephone calling and unattended recording of the telephone set or the like are operated according to control by the microcomputer 12.

Next, a description is made of the memory configuration.

Figure 2:
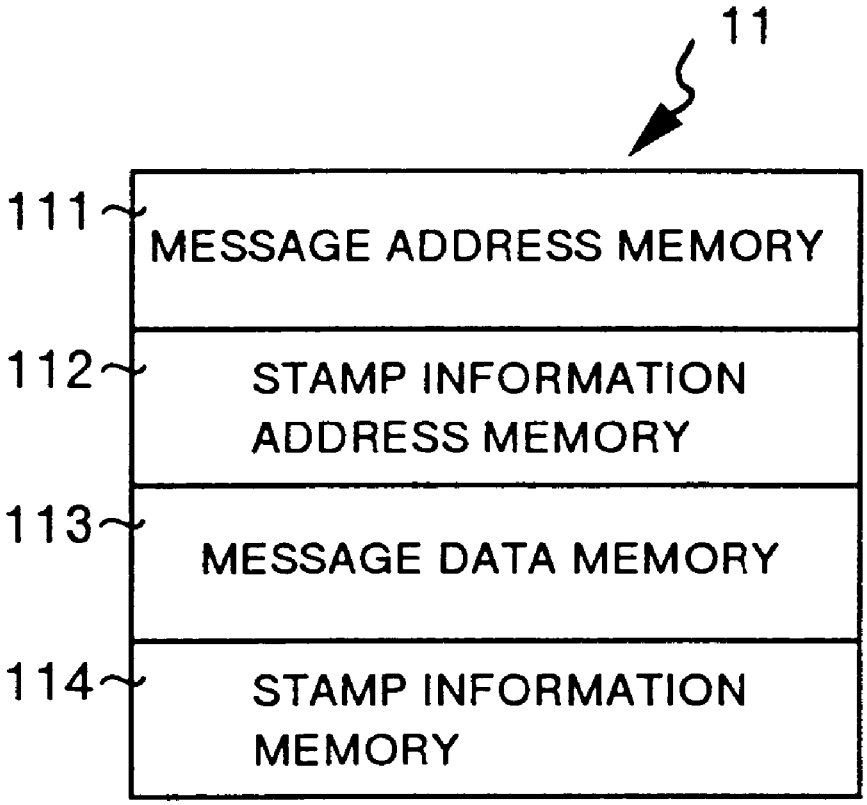
FIG. 2 is a view showing an example of the memory configuration of a flash memory according to this embodiment.
Figure 4:
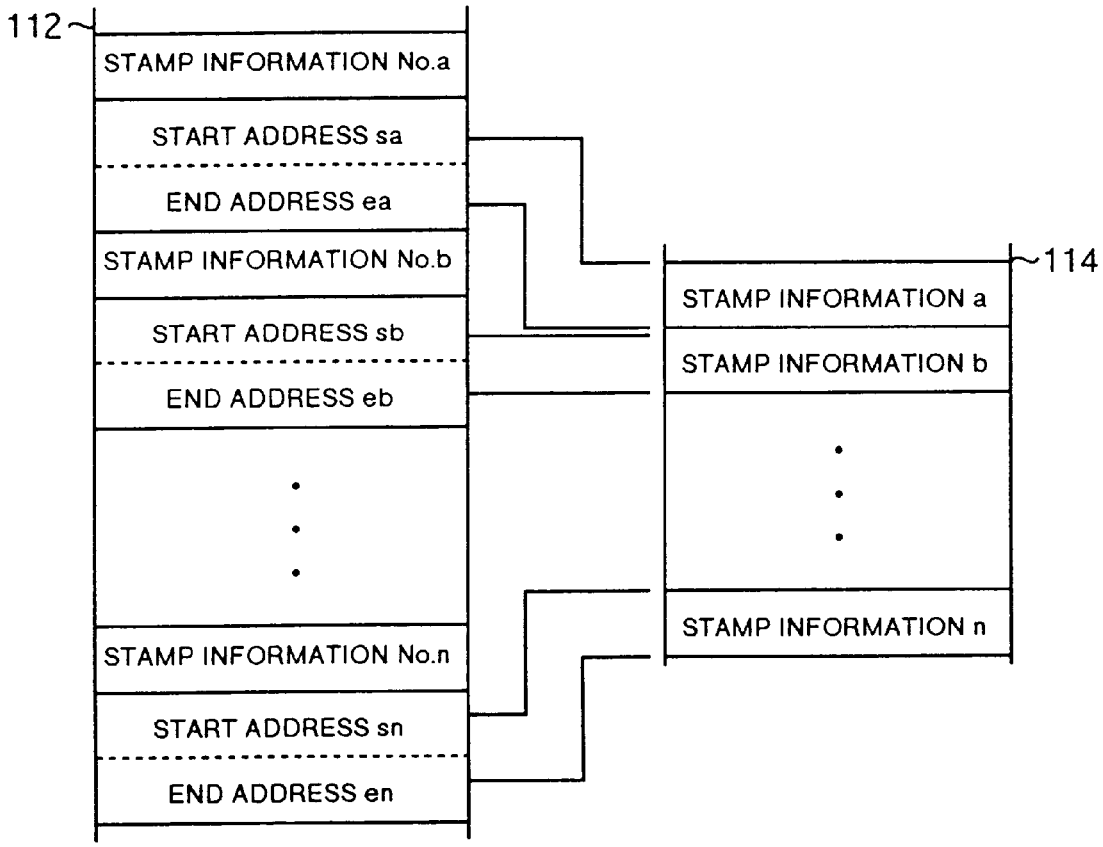
FIG. 4 is an explanatory view showing how data concerning a stamp are connected to each other in this embodiment.
Figure 5:
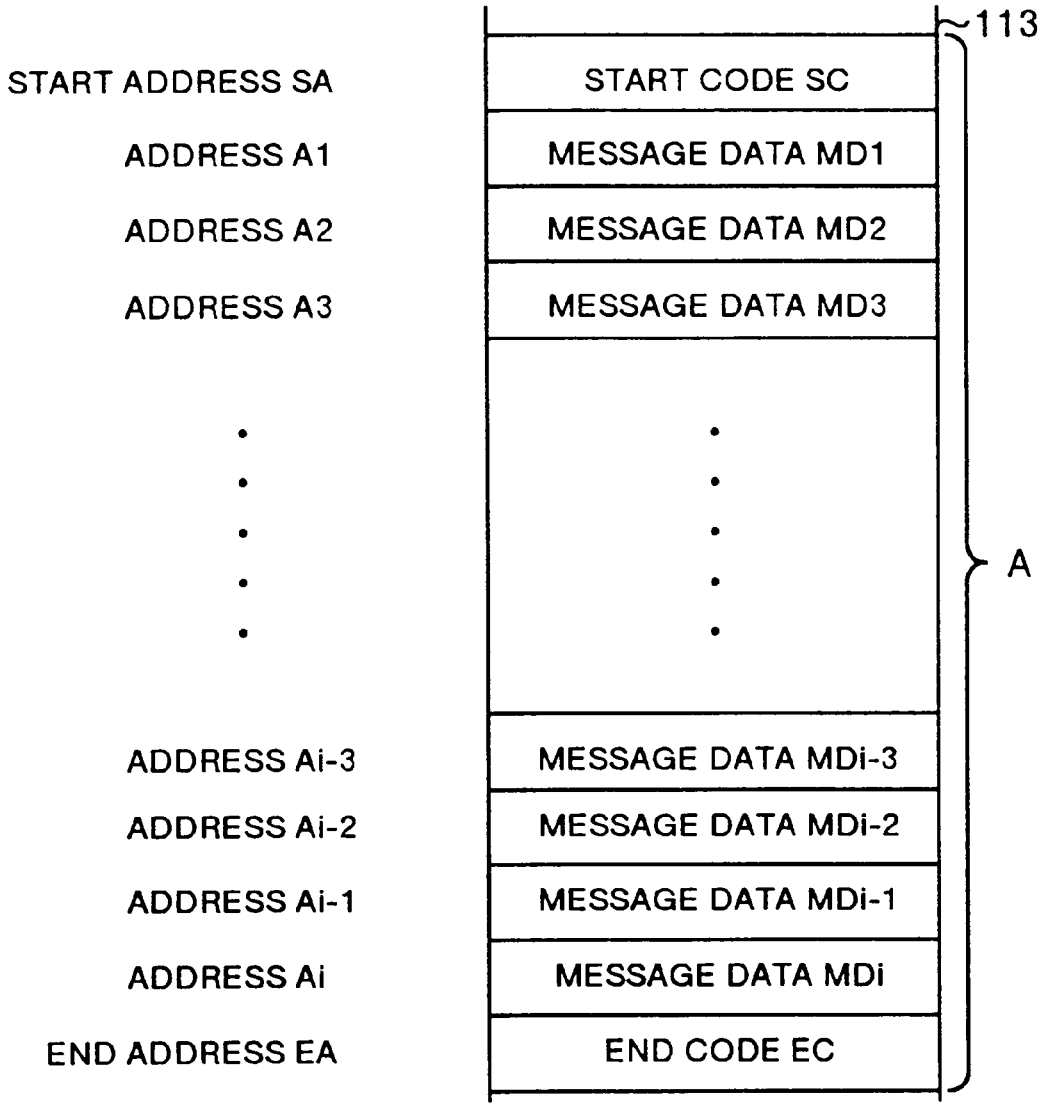
FIG. 5 is a view showing an example of storage of data concerning a message in this embodiment.

At first, a description is made for the flash memory 11. FIG. 2 shows an example of the memory configuration in the flash memory 11, FIG. 3 helps illustrate how pieces of data concerning messages are coupled to each other, FIG. 4 illustrates how a plurality of pieces of data concerning stamp information are coupled to each other, and FIG. 5 shows an example of how a plurality of pieces of data concerning messages are stored therein.

In a case where an speech signal is to be stored in the flash memory 11, the speech signal has already been compressed by the ADPCM system. Herein, a compressed signal stored in the flash memory 11 is defined as message data to distinguish it from a speech signal on telephone calling.

The flash memory 11 comprises, as shown in FIG. 2, a message address memory 111, a stamp information address memory 112, a message data memory 113, and a stamp information memory 114 or the like.

Figure 3:
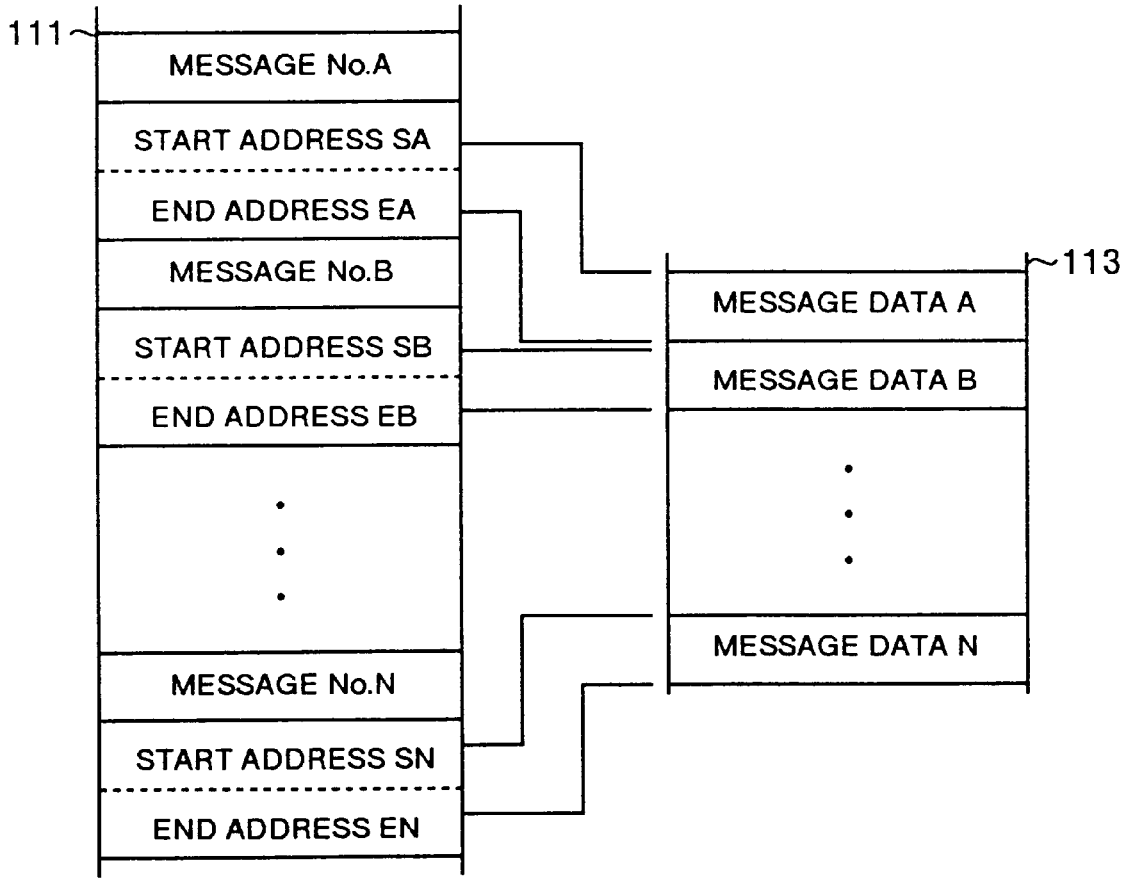
FIG. 3 is an explanatory view showing how data concerning a message are connected to each other in this embodiment.

The message address memory 111 is an area for storing, as shown in FIG. 3, message numbers, start addresses, and end addresses correlating with each of message data A, B, . . . , and N (N: a natural number) each stored in the message data memory 113.

The message data memory 113 stores each of the message data A, B, . . . , and N in any part of the area specified by the start address and the end address stored in the message address memory 111.

For instance, the message data A for message No. A is specified by the start address as "SA" as well as by the end address as "EA", and the message data N for the message No. N is specified by the start address as "SN" as well as by the end address as "EN".

Also, the stamp information address memory 112 is an area for storing, as shown in FIG. 4, message numbers, start addresses, and end addresses correlating with each of stamp information a, b, . . . , and n (n is a natural number and takes a common value with N) each stored in the stamp information memory 114.

The stamp information memory 114 stores each of the stamp information a, b, . . . , and n in any part of the area specified by the start address and the end address stored in the stamp information address memory 112.

For instance, the stamp information a for the stamp information No. a is specified by the start address as "sa" as well as by the end address as "ea", and the stamp information n for the stamp information No. n is specified by the start address as "sn" as well as by the end address as "en".

It should be noted that a message and the stamp information are stored in correspondence to each other when unattended recording is operated. For this reason, it can be considered that a message number and a stamp information number which are identical to each other (expressed in the uppercase letters and lowercase letters in FIG. 3 and FIG. 4 respectively) correspond to each other. Namely, the data for the message No. A corresponds to the stamp information No. a.

Further detailed description is made for the message data memory 113, and, as the message data A shown in FIG. 5, addresses Al to Ai (i: a natural number) specifying a destination for storage of the message data A are set between the start address SA and the end address EA. This figure shows a case where a quantity of data for the message data A is i pieces, and the i pieces of message data MDl to MDi are stored at the addresses Al to Ai respectively.

Further start code SC of the message data A is stored at the start address SA and an end code EC thereof is stored at the end address EA. The microcomputer 12 can recognize the start of the message data A by reading out the start code SC and also recognize the end of the message data A by reading out the end code EC.

Figure 6:
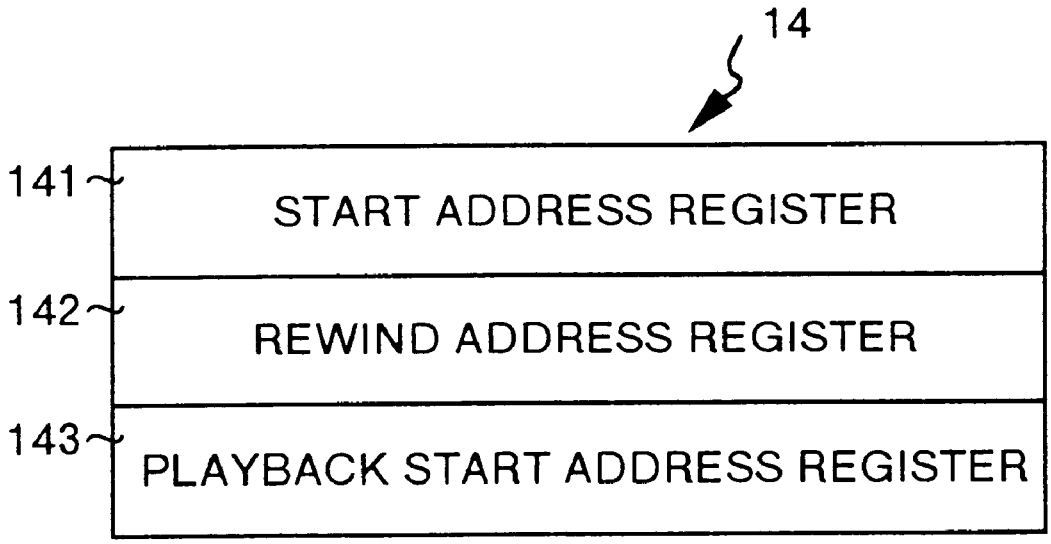
FIG. 6 is a view showing an example of a RAM memory configuration according to this embodiment.

Then, description is made for the RAM 14. FIG. 6 is a view showing an example of a memory configuration of the RAM 14.

The RAM 14 comprises, as shown in FIG. 6, a start address register 141, a rewind address register 142, and a playback start address register 143 other than a work area not shown herein.

The start address register 141 is a memory for storing a start address for playing back an arbitrary message when the message recorded by the function for unattended recording is played back. Stored at this start address is the start code SC as described above, and with this start code SC, the immediately preceding message beyond the start address is prevented from being specified as a destination for playback when rewind is operated.

The rewind address register 142 is a memory for storing the accessed message address as a rewind address when rewinding is executed while the message recorded by the function for unattended recording is played back, or the end address of the message as a rewind address when rewinding is executed while the stamp information corresponding to the message is played back after the message is played back.

As described above, the operation for rewinding during playback of the stamp information is controlled according to playback from the end address of the message corresponding to the stamp information.

The playback start address register 143 is a memory for storing the message address at a destination for playback determined in response to a rewind operation as a start address for playing the memory back and playing back the message.

Figure 7:
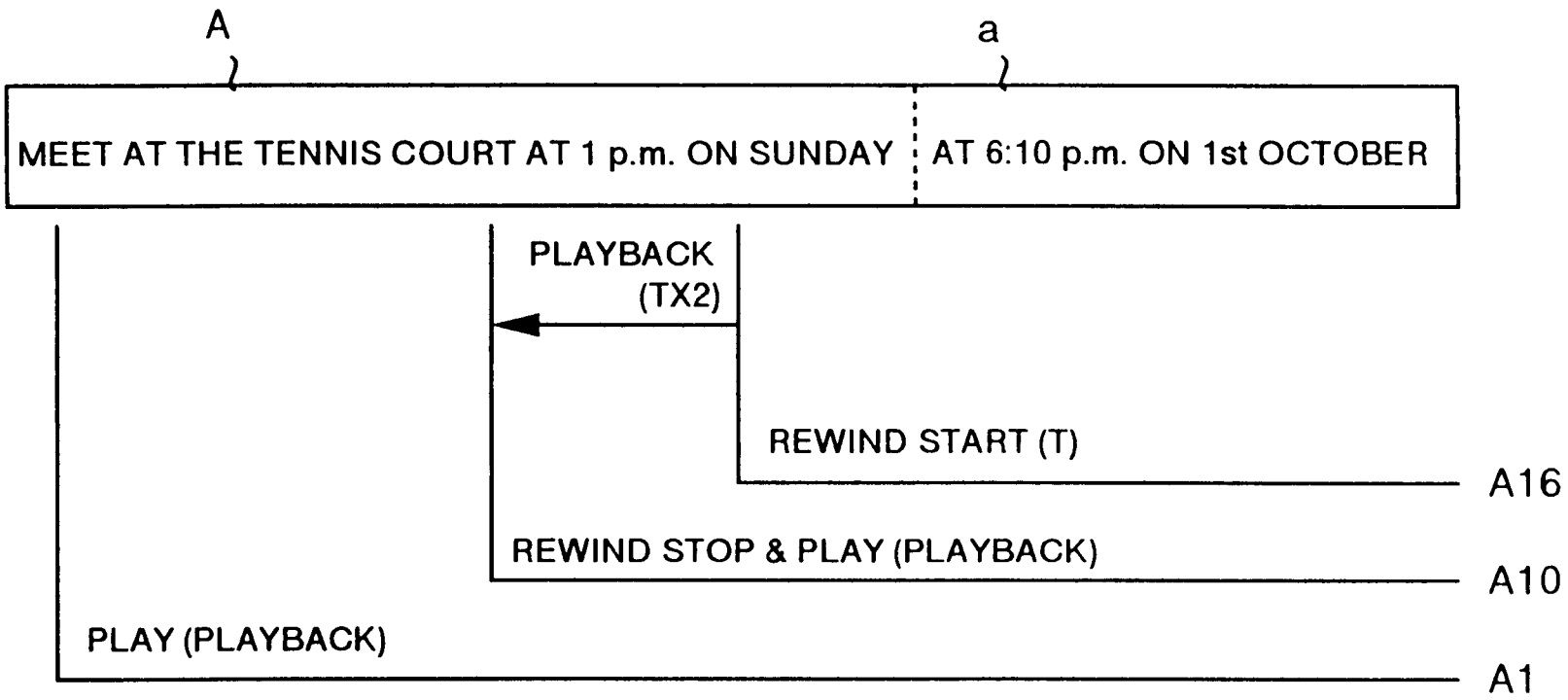
FIG. 7 is an explanatory view showing a playback method when a message is played back in this embodiment.
Figure 8:
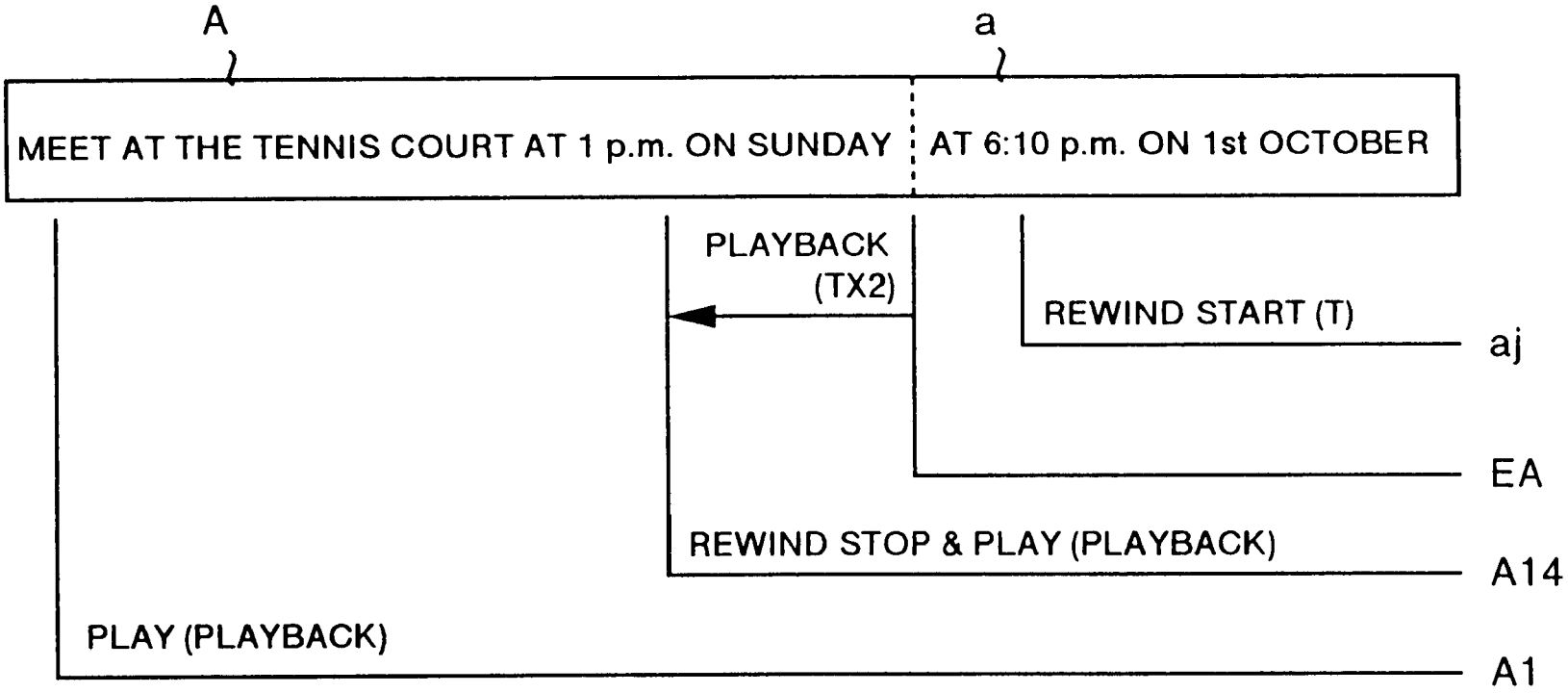
FIG. 8 is an explanatory view showing a playback method when stamp information is played back in this embodiment.

Next, a description is made for a playback method. FIG. 7 is a view for explaining the playback method during playback of a message, and FIG. 8 is a view for explaining the playback method during playback of stamp information.

In this embodiment, two types of playback method are prepared: one of them is playback of a message, and the other is playback of stamp information.

FIG. 7 shows the contents of message data A concerning the message No. A as well as of the stamp information a thereof. Content of the message according to the message data A is "Meet at the tennis court at 1 p.m. on Sunday ", and that of the time information for the stamp information a is "at 6:10 p.m. on 1st October".

The example in FIG. 7 shows a case where the actual message portion of the message data A comprises message data MD1 to MD 19 (i=19), and absolute addresses for accessing the flash memory 11 are addresses A1 to A19 each corresponding to the message data MD1 to MD19.

For this reason, when operation of the rewind key 16*a* is detected after playback of the message data MD1 for the address A1 of the message No. A is started by reading it until the end of the message is determined by reading the end code EC stored in the end address EA, an address identified when the flash memory 11 is accessed at a point of time of execution of rewinding becomes a rewind address for starting the rewinding operation.

The rewind address in the example in FIG. 7 is address A 16. A speech played back at the point of time when this rewinding operation is executed, for instance, "ON" (the message data A).

When the rewind key 16*a* is continuously pressed down for T seconds, the time obtained by multiplying a period of time T (sec) when the key is continuously pressed down by m (m: a natural number) becomes the playback time. The address at a destination for playback rewound from the rewind address by this playback time is a start address for playback.

In the example in FIG. 7, a period of time T (sec) when the key is continuously pressed down is multiplied by 2 (m=2), so that the start address for playback is the address A10 which is a relative position obtained by rewinding the messages by T×2 (sec) according to the address A 16 as a starting point. In this case, a first speech played back after the playback is, for instance, "COURT" (the message data A).

In the example shown in FIG. 8, when pressing down of the rewind key 16*a* is detected after the playback of the message is ended by reading out the message data MD1 to MD19 for the message No. A when the stamp information a is played back, it is determined that the stamp information a is played back from the address aj when the flash memory 11 is accessed at the time when the operation is executed. The end address EA of the message data A is replaced by a rewind address for starting the rewinding operation according to the result of this determination.

A rewind address in the example shown in FIG. 8 is the end address EA, and the played back speech when the rewind is operated is, for instance, "10" (stamp information a).

Also during an operation for rewinding, to play back the stamp information, as in playing back a message, when the rewind key 16*a* is continuously pressed down for T seconds, a playback time is obtained by multiplying a period of time T (sec) by m (m: a natural number). The address at a destination for playback obtained by rewinding by this playback time is a start address for playback.

In the example in FIG. 8, a period of time T (sec) when the key is continuously pressed down is multiplied by 2 (m=2), so that the start address for playback is the address A 14. A first speech played back after the playback is, for instance, "ON" (the message data A).

Next, a description is made for operations. FIG. 9 to FIG. 13 are flow charts each for explaining processing controlled by the microprocessor 12, FIG. 9 shows the main processing, FIG. 10 shows processing for recording, FIG. 11 and FIG. 12 show processing for playback, and FIG. 13 shows processing for rewinding.

It is assumed that initialization has already been completed in the telephone device 1 and a user has set the function for unattended recording therein. At first, generation of a recording event is detected in step S1. This recording event is generated in response to reception of a call after the function of unattended recording is set.

In a case where generation of a recording event is detected in step S1, processing moves to step S2 and recording processing is executed (refer to FIG. 10), and then processing moves to step S3. On the other hand, in a case where generation of the recording event is not detected, the processing jumps to step S3.

In step S3, in a case where the fact that the playback key (operating section 16), not shown herein, is operated is sensed and detected, processing moves to step S4 and playback is executed (refer to FIG. 11 and FIG. 12), and then processing moves to step S5. On the other hand, in a case where playback key operation is not detected, the processing jumps to step S5.

In step S5, in a case where the fact that other key (operating section 16), not shown herein, is operated is sensed and detected, processing moves to step S6 and processing other than playback in response to a key is executed, and then processing returns to step S1. On the other hand, in a case where the fact that other key is operated is not detected, processing returns again to step S1.

Next, a detailed description is made for recording processing in step S2 with reference to FIG. 10.

In recording processing, at first, time data for a current time is referred from the timer 15 for preparing stamp information. This stamp information is stored in the flash memory 11 by allocating new stamp information Number thereto before the message is recorded (step S11).

After the operation described above, a recording start command C1 is prepared for being outputted to the speech signal processing circuit 10 (step S12). The speech signal processing circuit 10 starts recording when receiving the recording start command C1 from the microcomputer 12. The message to be recorded at that time is in the form of compressed message data, and the message data is stored in the flash memory 11 with the number identical to that of the stamp information previously stored therein. A start code SC is added to the header (a start address) of the message data.

Then in step S13, generation of a recording-stop event is sensed, and processing shifts to step S14 while generation thereof is not detected and determination is made as to whether timeout of the recording time previously set occurs or not. Namely, the processing in steps S13 and S14 is repeatedly executed until the recording event is generated or a determination is made that timeout of the recording time previously set occurs.

Then, when the recording event is generated (step S13), or when timeout of the recording time occurs (step S14), processing moves to step S15. In this step S15, recording stop command C2 is prepared for being outputted to the speech signal processing circuit 10.

When the recording stop command C2 is received, the speech signal processing circuit 10 stops the recording operation. At this point of time, an end code EC is added to the end of the message data (end address).

After this step S15, processing returns to the main processing (Refer to FIG. 9), and then to step S3.

Next, detailed description is made for playback processing in step S4 (Refer to FIG. 9) with reference to FIG. 11 to FIG. 13. In this playback processing, at first, a start address for playback of each of messages is stored in the start address register 141 (step S21). A start address in this case is supplied from the speech signal processing circuit 10 before playback is executed.

Then, a message to be played back is specified and a playback start command C3 for the message is prepared for being outputted to the speech signal processing circuit 10 (step S22). A start address to be played back, stored in the start address register 141, is included in this playback start command C3 as information.

In step S23, the fact that the rewind key 16a is operated is sensed, and while the operation is not detected, processing moves to step S27. In this step S27, it is determined that processing has not yet reached the end address until the end code EC is supplied from the speech signal processing circuit 10 and playback of the message is repeated.

On the other hand, where the fact that the rewind key 16*a* is operated (namely pressed down) is detected in step S23, processing moves to step S24. In this step S24, an address when the flash memory 11 is accessed is stored in the rewind address register 142 as a rewind address at a point of time when the rewind key 16*a* is pressed down.

After the operation, processing moves to step S25, a playback stop command C4 is prepared for being outputted to the speech signal processing circuit 10, and rewind processing is executed in step S26 (Refer to FIG. 13). Then, processing returns to step S22.

When the fact that the processing has reached the end address is recognized in step S27, processing moves to step S28, and the end address is stored in the rewind address register 142 as a rewind address.

After the operation, processing moves to step S29, and a playback stop command C4 is prepared for being outputted to the speech signal processing circuit 10. Then, processing moves to step S30 (Refer to FIG. 12).

In step S30, a playback start command C5 for stamp information is prepared in order to play back a message and the stamp information corresponding to the message, and the command is outputted to the speech signal processing circuit 10. The speech signal processing circuit 10, when receiving the playback start command CS for stamp information, reads and plays back stamp information by accessing the stamp information with the stamp information number identical to that of the message already played back.

In step S31, the fact that the rewind key 16*a* is operated is sensed, and while the operation is not detected, processing moves to steps S34 and S35. In step S34, output of the stamp information is controlled, and then in step S35, it is determined that the processing has not yet reached the end address until the end code EC is supplied from the speech signal processing circuit 10 and playback of the message is repeated.

On the other hand, in a case where the fact that the rewind key 16*a* is operated (pressed down) is detected in step S31, processing moves to step S32. In this step S32, the stamp information is being played back at a point of time when the rewind key 16*a* is pressed down, so that a state in which the rewind address is stored in the rewind address register 142 is maintained in the previous step S28, and playback stop command C6 for stamp information is prepared and processing for outputting the command to the speech signal processing circuit 10 is executed.

Then in step S33, rewind processing is executed (refer to FIG. 13). Then, processing returns to step S22 (refer to FIG. 11).

When the fact that the processing has reached the end address is recognized in step S35, playback of the message as well as stamp information in a state in which the rewind is not operated is ended, and processing moves to step S36. In this step S36, a playback stop command C6 for the stamp information is prepared for being outputted to the speech signal processing circuit 10.

Then, processing shifts to step S37, and whether the next message is present or not is checked. As a result, if it is determined that the next message is present, processing moves to step S38 and processing for the stamp information for the next message is executed, and after the execution, processing returns to the initial step S21 for the playback processing. On the other hand, if it is determined that the next message is not present, playback processing is terminated, and processing goes to step S5 for the main processing (refer to FIG. 9).

Further detailed description is made for rewind processing in step S26 (refer to FIG. 11) as well as in step S33 (refer to FIG. 13) in this processing for playback.

In rewind processing, at first, a period of time when the rewind key 16*a* is already pressed down and is continuously pressed down is measured. A message address at a destination for playback is computed so that a time twice the period of time when the key is continuously pressed down will be a playback time according to the rewind address stored in the rewind address register 142 as a starting point (step S41). The processing in this step S41 is continued while the rewind key 16*a* is continuously pressed down.

In step S42, the fact that the operation of the rewind key 16*a* has been terminated, that is, the rewind key 16*a* has been released, is sensed, and processing moves to step S44 while release of the rewind key 16*a* is not detected. In this step S44, it is determined that the processing has not reached the start address until the start code SC is supplied from the speech signal processing circuit 10, so that a message address at a destination for playback is continuously computed.

On the other hand, in a case where the fact that the rewind key 16*a* has been released is detected in step S42, processing moves to step S43. In this step S43, the message address continuously computed is stored in the playback start address register 143 as a start address at a destination for playback. Then, processing moves to step S22 in order that the rewind processing in step S26 or in step S33 is terminated.

Also, where the fact that the processing has reached the start address is detected in step S43, processing moves to step S45, and the start address is stored in the playback start address register 143 as a start address at a destination for a playback. Then, processing moves to step S22 in order that the rewind processing in step S26 or in step S33 is terminated.

In the embodiment described above, the playback time is set to twice a period of time the rewind key 16*a* is continuously pressed, but playback time is not limited thereto, and magnification such as three times or four times or any other integral number of times may be employed. Also, the magnification may be freely selected from among a plurality of multiples with key operation each so far as a relation between a period of time when the key is continuously pressed and a playback time is proportional to each other.

As described above, with the embodiment, in the flash memory 11 which is an IC memory, a playback time having a proportional relation with the period of time the rewind key 16*a* is continuously pressed is obtained and a message from the message address at a destination for playback based on the playback time is read out for playing back the message, so that a destination for playback is not restricted to a header portion of the message. For this reason, a message address at a destination for playback is variable depending on the length of the playback time obtained by pressing down the rewind key 16*a*. For this reason, it is possible to play back any part of a message from an arbitrary position of the message, as in a magnetic tape.

Also, in the flash memory 11 which is an IC memory, a playback time having a proportional relation with a period of time when the rewind key 16*a* is continuously pressed down during playback of the stamp information is obtained and a message from the message address at the destination for a playback depending on the playback time is read out for playing back it. The destination for playback thus is not restricted to the header portion of the message corresponding to the stamp information. For this reason, a message address at the destination for playback is variable depending on the length of the playback time obtained by pressing the rewind key 16*a*. In this case also, it is possible to play back any part of a message from an arbitrary position corresponding to the stamp information, as in a magnetic tape even during the playback of stamp information.

A playback time is controlled so that a destination for playback is limited within a message address of the current message according to the period of time required for playback the message (a period of elapsed time required for the playback), so that it is possible to partially play back within a certain message before the playback time reaches the period of elapsed time for the playback.

Also, playback time is computed so that it has a proportional relation such as m-multiple or the like (m: a natural number) with a period of time the key is continuously pressed down, so that speed for rewinding is up. In this case also, it is possible to realize a rewind operation, close to that of magnetic tape, in the flash memory 11.

As explained above, with the message playback device according to the present invention, in an IC memory, a message is read out and played back from a message address at a destination for playback depending on an inputted playback time. The destination for playback thus is not limited to a header section of the message, and the message address at the destination for playback can be changed according to a period of the playback time. It accordingly is possible to obtain a message playback device enabling playback of a message from an arbitrary position of the message, as in a message recorded on a magnetic tape.

With the message playback device according to the present invention, in an IC memory, playback time is computed depending on the period of time a rewind key is continuously pressed down, and a message is read out and played back from a message address at a destination for playback according to the playback time. The destination for playback thus is not limited to a header section of the message, and the message address at the destination for playback can be changed according to a period of the playback time corresponding to a period of time the rewind key is continuously pressed down. It thus is possible to obtain a message playback device enabling playback of a message from an arbitrary position of the message, as in a message recorded on a magnetic tape.

With the message playback device according to the present invention, in an IC memory, a message is read out and played back from a message address at a destination for playback depending on a playback time inputted while time-stamp information is played back. The destination for playback hence is not limited to a header section of the message corresponding to the time-stamp information, and the message address at the destination for playback can be changed according to a period of the playback time. It thus is possible to obtain a message playback device enabling playback of a message from an arbitrary position corresponding to the time-stamp information, as in a message recorded on a magnetic tape, even when the time-stamp information is being played back.

With the message playback device according to the present invention, in an IC memory, a playback time is computed depending on a period of time a rewind key is continuously pressed down while time-stamp information is generated, and a message is read out and played back from a message address at a destination for playback depending on the playback time. The destination for playback thereby is not limited to a header section of the message corresponding to the time-stamp information, and the message address at the destination for playback can be changed according to a period of the playback time corresponding to a period of time when the rewind key is continuously pressed down. It thus is possible to obtain a message playback device enabling playback of a massage from an arbitrary position corresponding to the time-stamp information, as in a message recorded on a magnetic tape, even when time-stamp information is being played back.

With the message playback device according to the present invention, a playback time is controlled so that a destination for playback is limited within a message address for the current message according to a period of time required for playback of the current message. It thus is possible to obtain a message playback device enabling partial playback within one message until the playback time reaches the period of time required for playback.

With the message playback device according to the present invention, playback time is computed by multiplying the period of time a rewind key is continuously pressed down by m (m: a natural number). Rewind speed becomes faster, so that it is possible to obtain a message playback device enabling a rewind operation close to that of a magnetic tape in an IC memory.

With the message playback method according to the present invention, in an IC memory, playback time is computed according to a period of time when the rewind key is continuously pressed down and a message is read out and played back from a message address at a destination for playback corresponding to the playback time. The destination for playback hence is not limited to a header section of the message, and the message address at the destination for playback can be changed according to a period of the playback time corresponding to the period of time the rewind key is continuously pressed down. It thus is possible to obtain a message playback method enabling playback of a message from an arbitrary position of the message, as in a message recorded on a magnetic tape.

With the message playback method according to the present invention, in an IC memory, playback time is obtained according to a period of time the rewind key is continuously pressed down while time-stamp information is being played back, and a message is read out and played back from a message address at a destination for playback depending on the playback time. The destination for playback thus is not limited to a header section of the message corresponding to the time-stamp information, and the message address at the destination for playback can be changed according to the playback time corresponding to the period of time the rewind key is continuously pressed down even while time-stamp information is being played back. It thereby is possible to obtain a message playback method enabling playback of a message from an arbitrary position corresponding to time-stamp information, as in a message recorded on a magnetic tape.

This application is based on Japanese patent application No. HEI 8-290679 filed in the Japanese Patent Office on Oct. 31, 1996, the entire contents of which are hereby incorporated by reference.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A message playback device for playing back a message recorded in an IC memory, comprising:

an input device for inputting a playback time when any playing message recorded in said IC memory is to be played back;

a memory device for storing a message address at a point of time said input device is activated;

a computing device for determining a message playback destination address using the message address stored in said memory device as a starting point, said playback destination address being a function of the playback time inputted by said input device; and a playing back device for reading out the message recorded in the IC memory beginning at the message playback destination address and playing back the read out message.

2. The message playback device according to claim 1, wherein the message playback destination address is limited to be within an address of the playing message.

3. A message playback device for playing back a message recorded in an IC memory, comprising:

a rewind key for rewinding any playing message recorded in said IC memory for playing back the playing message stored therein;

a measuring device for detecting the fact that said rewind key is pressed down during playing of the playing message and measuring a period of time when said rewind key is continuously pressed down;

a memory device for storing a message address in said IC memory at a point of time said measuring device is activated;

a computing device for determining a playback time as a function of the period of time that the rewind key is continuously pressed down as measured by the measuring device and controlling rewinding of the playing message from said message address to a message playback destination address using the determined playback time; and a playing back device for reading out the message recorded in said IC memory beginning at the message playback destination address and playing back the read out message.

4. The message playback device according to claim 3, wherein the message playback destination address is limited to be within an address of the playing message.

5. The message playback device according to claim 3, wherein the computing device determines the playback time by multiplying the period of time the rewind key is continuously pressed down by m (m: a natural number).

6. The message playback device according to claim 3, wherein the message playback destination address is limited to be within an address of the playing message.

7. The message playback device according to claim 3, wherein the computing device determines the playback time by multiplying the period of time the rewind key is continuously pressed down by m (m: a natural number).

8. A message playback device for playing back a message recorded in an IC memory as well as time-stamp information recorded in correspondence to the message, comprising:

an input device for inputting a playback time when any playing message recorded in said IC memory is to be played back during playing of the corresponding time-stamp information;

a memory device for storing an end of message address of said playing message when said input device is activated during playing of the corresponding time-stamp information;

a computing device for determining a message playback destination address using the end of message address of said playing message stored in said memory device as a starting point, said message playback destination being a function of the playback time inputted by said input device; and a playing back device for reading out the message recorded in the IC memory beginning at the message playback destination address and playing back the read out message.

9. The message playback device according to claim 8, wherein the message playback destination address is limited to be within an address of said playing message.

10. A message playback device for playing back a message recorded in an IC memory as well as time-stamp information recorded in correspondence to the playing message, comprising:

a rewind key for rewinding any playing message stored in said IC memory for playing back the playing message stored therein;

a measuring device for detecting the fact that said rewind key is pressed down during playing of the corresponding time-stamp information of the playing message and measuring a period of time when said rewind key is continuously pressed down;

a memory device for storing an end of message address of said playing message when said measuring device is activated during playing of the corresponding time-stamp information of said playing message;

a computing device for determining a playback time as a function of the period of time that the rewind key is continuously pressed down as measured by the measuring device and controlling rewinding of the playing message from said end of message address to a message playback destination address using the determined playback time; and a playing back device for reading out the message recorded in the IC memory beginning at the message playback destination address and playing the read out message.

11. A message playback method for playing back a message recorded in an IC memory, comprising the steps of:

detecting the fact that a rewind key for rewinding a message recorded in said IC memory is pressed down during playing of the message;

storing a message address of the playing message stored in said IC memory when pressing down of the rewind key is detected during playing of the message;

measuring a period of timed said rewind key is continuously pressed down during playing of the message;

determining a playback time as a function of the period of time the rewind key is continuously pressed down during playing of the message;

controlling rewinding of the playing message from said message address to a message playback destination address using the determined playback time;

reading out the message recorded in said IC memory beginning at the message playback destination address; and playing back the read out message.

12. A message playback method for playing back a message recorded in an IC memory and time-stamp information recorded in correspondence to the message, comprising the steps of:

detecting the fact that a rewind key for rewinding a message recorded in said IC memory is pressed down during playing of the corresponding time-stamp information;

storing an end of message address of the playing message stored in said IC memory when pressing down of the rewind key is detected during playing of the corresponding time-stamp information;

measuring a period of timed said rewind key is continuously pressed down during playing of the corresponding time-stamp information;

determining a playback time as a function of the period of time the rewind key is continuously pressed down during playing of the corresponding time-stamp information;

controlling rewinding of the playing message from said end of message address to a message playback destination address using the determined playback time;

reading out the message recorded in said IC memory beginning at the message playback destination address; and playing back the read out message.

13. A method of reproducing a message stored in a digital memory, comprising the steps of:

determining a time period which a rewind key is continuously activated during playing of a message;

storing a message address of the playing message stored in said digital memory when activation of the rewind key is detected during playing of the message;

determining a playback start address at which reproduction of the playing message is to begin using the message address and the determined time period; and playing back information stored in the digital memory beginning with said message playback start address.

14. The method of claim 13, wherein said start address at which reproduction of the playing message is determined as a function of the determined time period.

15. The method of claim 14, wherein said message is recorded in said digital memory between a message start address and a message end address.

16. The method of claim 15, wherein said playback start address is inclusively between the message start address and the message end address.

17. The method of claim 16, wherein time-stamp information is stored in the digital memory in correspondence to the message, and further comprising the step of using the message end address in the step of storing a message address when activation of the rewind key is detected during playing of the time stamp information.

* * * * *